US012241470B2

(12) United States Patent
Malone

(10) Patent No.: US 12,241,470 B2
(45) Date of Patent: Mar. 4, 2025

(54) SEALING ASSEMBLY FOR A PUMP WITH A LEAK PATH

(71) Applicant: COOPER-STANDARD AUTOMOTIVE, INC., Northville, MI (US)

(72) Inventor: David S. Malone, Attica, MI (US)

(73) Assignee: Cooper-Standard Automotive Inc., Northville, MI (US)

( * ) Notice: Subject to any disclaimer, the term of this patent is extended or adjusted under 35 U.S.C. 154(b) by 360 days.

(21) Appl. No.: 17/679,873

(22) Filed: Feb. 24, 2022

(65) Prior Publication Data

US 2023/0265841 A1 Aug. 24, 2023

(51) Int. Cl.

| | |
|---|---|
| ***F04D 15/00*** | (2006.01) |
| ***F04B 53/06*** | (2006.01) |
| ***F04D 1/04*** | (2006.01) |
| ***F04D 13/06*** | (2006.01) |
| ***F04D 17/16*** | (2006.01) |
| ***F04D 29/08*** | (2006.01) |
| ***F04D 29/42*** | (2006.01) |

(52) U.S. Cl.

CPC ..... *F04D 15/0016* (2013.01); *F04B 53/06* (2013.01); *F04D 1/04* (2013.01); *F04D 13/0606* (2013.01); *F04D 17/16* (2013.01); *F04D 29/08* (2013.01); *F04D 29/4293* (2013.01)

(58) Field of Classification Search

CPC .... F04D 15/0016; F04D 1/04; F04D 13/0606; F04D 17/16; F04D 29/08; F04D 29/083; F04D 29/086; F04D 29/4293; F04B 53/06

See application file for complete search history.

(56) References Cited

U.S. PATENT DOCUMENTS

| | | | | |
|---|---|---|---|---|
| 4,679,983 | A * | 7/1987 | Pietryk | F04D 29/486 415/152.2 |
| 7,441,545 | B1 | 10/2008 | Fisher et al. | |
| 10,161,411 | B1 | 12/2018 | Gottschalk et al. | |
| 2004/0184937 | A1 | 9/2004 | Hueppchen | |
| 2016/0047079 | A1* | 2/2016 | Maiero | D06F 39/085 68/139 |

* cited by examiner

*Primary Examiner* — David N Brandt

(74) *Attorney, Agent, or Firm* — Paschall & Associates, LLC; James C. Paschall; Anthony Miologos

(57) ABSTRACT

An assembly and process for draining fluid leaks from a pump housing is disclosed. The pump housing includes an internal mounting cavity, a valve installed in the mounting cavity and at least one housing passage extending to an exterior surface of the pump housing. A valve passage is formed through a wall of the valve. An interior fluid seal is installed on an interior surface of the valve forming a seal between the valve interior surface and a first surface of the mounting cavity. An exterior fluid seal is installed on an exterior surface of the valve that forms a seal between the valve exterior surface and a second surface of the mounting cavity. An inner leak path is created through the interior fluid seal to the valve passage. The valve passage collects fluid leaking in the inner leak path. An outer leak path is created through the exterior fluid seal. The outer leak path in fluid communication with the valve passage and with the housing passage. Fluid leaking in the exterior fluid seal and fluid contained in the valve passage is drained through the housing passage to the exterior of the pump housing.

19 Claims, 13 Drawing Sheets

SEALING ASSEMBLY FOR A PUMP WITH A LEAK PATH

TECHNICAL FIELD

This disclosure is generally directed to pumps. More specifically, it relates to a sealing assembly for a pump that has a leak path through the sealing assembly.

BACKGROUND

Pumps are known and commonly used to move fluids, such as coolant in a vehicle. One example is cooling systems with water pumps, which are used for the cooling of different electrical components of the vehicle. These are hybrid or purely electric vehicles since vehicles with internal combustion engines do not comprise any electrical components that need to be cooled. Valves are used to ensure the distribution of the coolant throughout the cooling system. More recently pumps driven by electrical motors are being designed to include integrated valves. The valves arranged to be positioned by electrical actuators to control the flow from the pump through a plurality of outlets. In such integrated pump and valve assemblies that use a rotary valve to switch the flow from one outlet to another a stem/spindle is used to rotate the valve. A seal assembly is fitted to the valve stem/spindle to achieve sealing of the electrical valve actuator from the fluids being pumped and directed by the valve.

The stein/spindle sealing is achieved by compressing a soft flexible material between the stem/spindle and the bore of a packing box or a sealing surface of the pump housing. The selected material is typically softer than the valve parts to reduce wear. The material is typically very flexible so that it can "flow" into the available space in the sealing surface. At a micro-structure level, the flexible material must be able to flow into the surface finish irregularities of both the stem/spindle and the sealing surface. From a valve mechanical design viewpoint, the stem/spindle should have a large diameter to be able to resist bending forces have low stresses due to actuating forces and torque. From a valve sealing viewpoint the stem/spindle should be as small as possible to reduce the area of potential leak paths and utilize the smallest seal size to save material around the sealing surface of the housing. The two sets of objectives are in direct conflict and the final design is usually a compromise to achieve satisfactory performance. One compromise is to provide a channel for leakage of fluid to the exterior of a pump due to degradation or failure of the seal system. By controlling and directing leakage flow, leakage can be channeled away from the electrical pump motor or the electrical valve actuator components of the pump that may be damaged from the fluid leaks.

SUMMARY

This disclosure relates to a sealing assembly for a pump that has a leak path through the sealing assembly.

In a first embodiment, a sealing assembly with a leak path for a pump is disclosed. The assembly comprising a pump housing having a cylindrical mounting cavity, a fluid inlet, at least one fluid outlet, and at least one housing passage extending to an exterior surface of the pump housing. An impeller driven by a motor moves a fluid from the fluid inlet to the fluid outlet. A valve controls the flow of fluid through the fluid outlet. The valve includes an annular interior surface bearing against a first surface of the mounting cavity and an annular outer surface bearing against a second surface of the mounting cavity. At least one valve passage extends through the valve. An interior fluid seal is located about the perimeter of the valve interior surface forming a fluidic seal between the valve interior surface and the mounting cavity first surface. The interior fluid seal includes an inner leak path in fluid communication with the valve passage. The valve passage collecting the fluid leaking in the interior fluid seal from the inner leak path. An exterior fluid seal is located about the perimeter of the valve exterior surface forms a fluidic seal between the valve exterior surface and the mounting cavity second surface. The exterior fluid seal includes an outer leak path through the exterior fluid seal that is in fluid communication with the valve passage and with the housing passage. The exterior leak path is configured to collect fluid leaking in the exterior fluid seal and fluid contained in the valve passage and drain the leaking fluid to the housing passage and to the exterior of the pump housing.

In a second embodiment, a process for draining fluid leaks from a pump housing is disclosed. The pump housing includes an internal mounting cavity, a valve installed in the mounting cavity and at least one housing passage extending to an exterior surface of the pump housing, The process comprising forming at least one valve passage through a wall of the valve and installing an interior fluid seal on an interior surface of the valve forming a fluidic seal between the valve interior surface and a first surface of the mounting cavity. The process further includes installing an exterior fluid seal on an exterior surface of the valve that forms a fluidic seal between the valve exterior surface and a second surface of the mounting cavity. An inner leak path is created through the interior fluid seal to the valve passage. The valve passage collects fluid leaking in the inner leak path. The process further includes creating an outer leak path through the exterior fluid seal that is in fluid communication with the valve passage and with the housing passage. Fluid leaking in the exterior fluid seal and fluid contained in the valve passage are drained through the housing passage to the exterior of the pump housing.

Other technical features may be readily apparent to one skilled in the art from the following figures, descriptions, and claims.

BRIEF DESCRIPTION OF THE DRAWINGS

For a more complete understanding of this disclosure, reference is now made to the following description, taken in conjunction with the accompanying drawings, in which.

DETAILED DESCRIPTION

The figures, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

An example pump assembly comprises a pump including a housing having an inlet, at least one outlet and an impeller for moving a fluid from the inlet to the outlet. A pump motor drives the impeller to move the fluid, and a rotary valve between the impeller and the outlet selectively controls the flow of fluid through the outlet.

Figure 1:
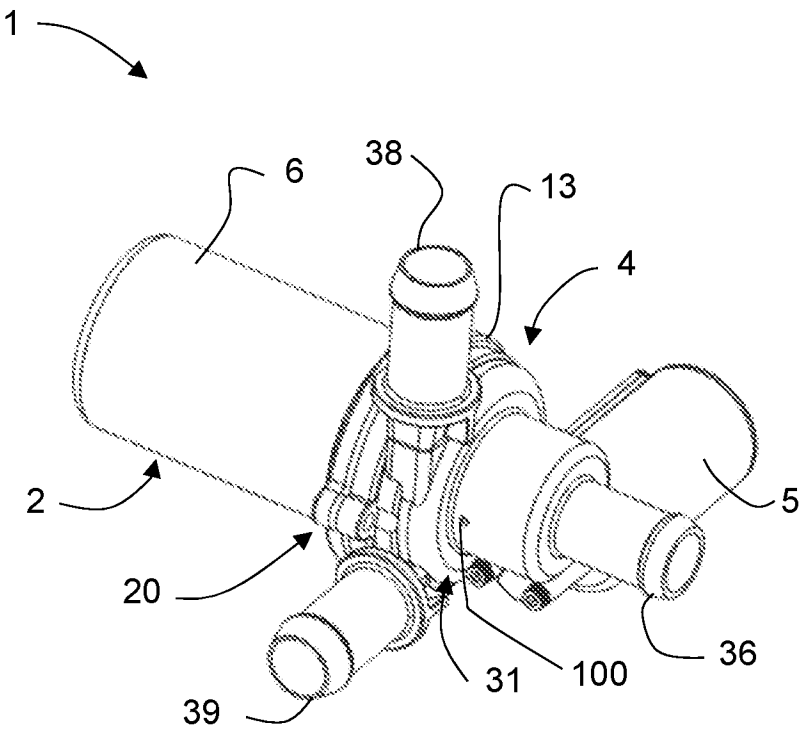
FIG. 1 illustrates a perspective view of an assembled pump assembly of the present disclosure.

FIG. 1 illustrates an example pump assembly 1 for pumping a fluid, such as a coolant, in a vehicle. As can be appreciated, the pump assembly 1 may also be used in non-vehicle applications. The example pump assembly 1 is an integration of a pump and a valve for selectively controlling flow from the pump assembly 1.

Figure 2:
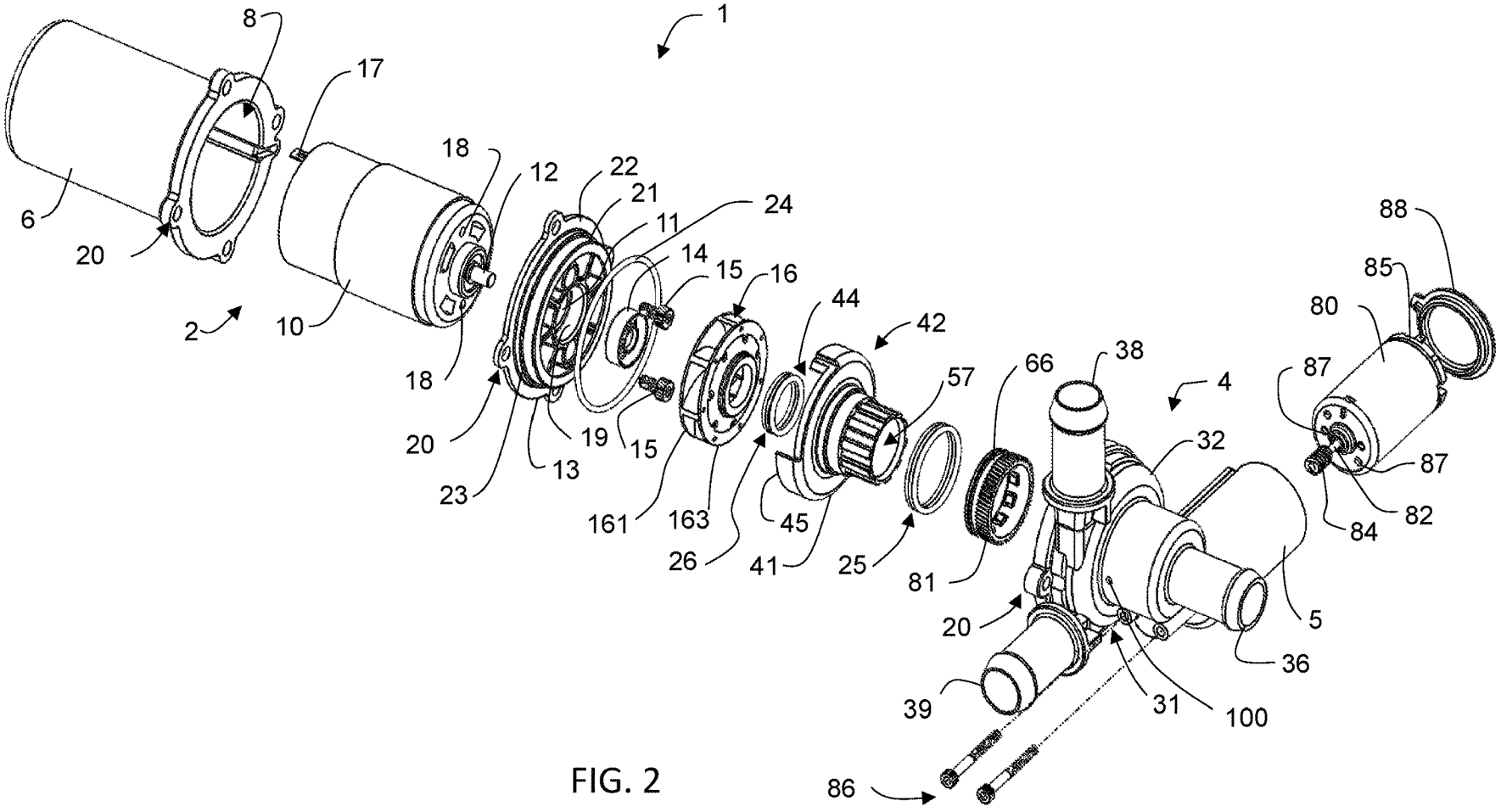
FIG. 2 illustrates an exploded view of the pump assembly of the present disclosure.
Figure 3:
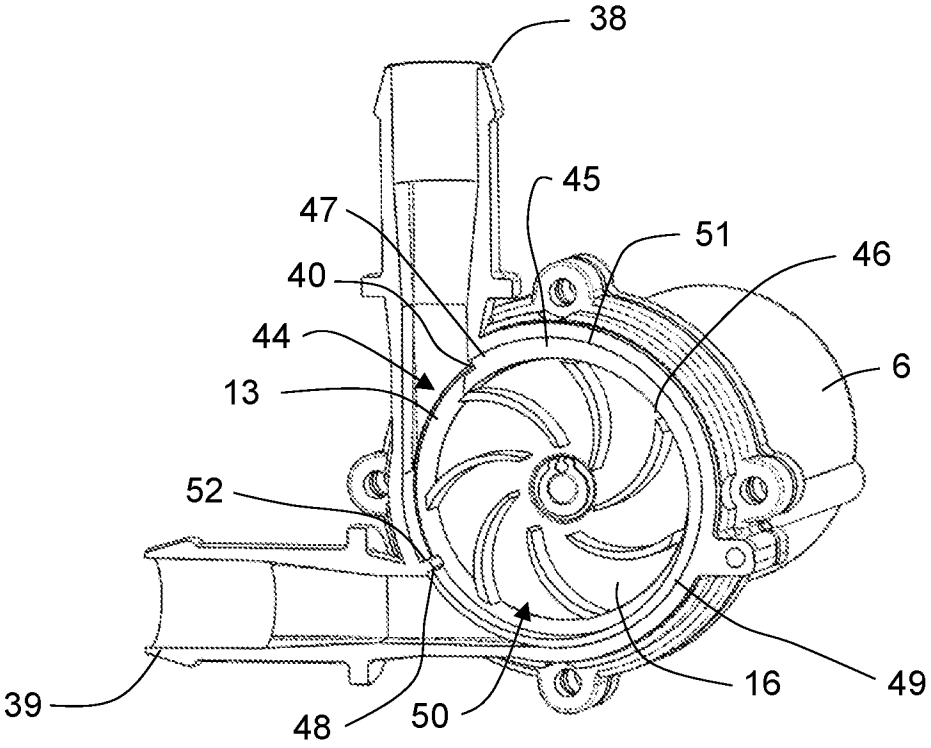
FIG. 3 illustrates a cross-sectional perspective view of a portion of the pump section of the present disclosure.

Referring back to FIG. 1 and also to FIG. 2, the pump assembly 1 includes a pump motor section 2 and a pump section 4. The pump motor section 2 includes a motor housing 6 that forms a motor cavity 8 therein. The pump motor housing 6 supports a pump motor 10 and a motor shaft 12 is installed through opening 11 of a pump motor mounting plate 13. The mounting plate 13 includes a wall 21 extending circumferentially from a first surface 22 of the mounting plate 13. The wall 21 includes a groove 23 extending along and outer periphery of wall section 21. An elastomeric sealing element, such as for example an O-ring 24 is arranged to be installed in groove 23. A seal member 14 is installed within a seal seat 19 molded on mounting plate 13. The impeller 16 includes a first vane plate 161 and a second vane plate 163 housing a plurality of impeller vanes therebetween. The impeller 16 is configured to be rotatable within the pump section 4 driven by the motor shaft 12. The pump motor 10 includes electrical connections 17 that extend from a rear portion of the motor 10 through a rear portion of motor housing 6. The electrical connections 17 adapted to receive electrical power from a remotely located power source to energize and operate the pump motor 10.

The mounting plate 13 is secured to the pump motor 10, in this example, using threaded fasteners 15 that extend through holes in the mounting plate 13 to engage threaded holes 18 on the face of pump motor 10. With the mounting plate 13 mounted on the pump motor 10 mounting tabs 20 located about the motor housing 6, the mounting plate 13 and the pump housing 31 are brought together and the wall 21 installed within an interior surface of pump housing 31. The O-ring 24 sealing against the interior surface of the pump housing 31 and wall 21. The mounting tabs 20 are aligned with each other to assemble and secure the motor section 2 to the pump section 4 using suitable fasteners (not shown). As can be appreciated, other types of fastening devices or techniques may be used to secure the pump section 4 and the motor section 2 together.

In the illustrated example of FIG. 2, the pump housing 31 of pump section 4 is formed essentially cylindrically and comprises a peripheral exterior wall 32. A fluid inlet 36, for example a suction inlet for sucking in a fluid, in this example a coolant, is positioned centrally to the rotary axis of the pump housing 31. The pump housing 31 also includes at least one fluid outlet for discharging fluid from the pump section 4. In this embodiment, two fluid outlets 38, 39 are shown. A first fluid outlet 38, and a second fluid outlet 39 extend from the wall 32 and are axially offset from each other such that the centers of the fluid outlets 38, 39, in the example, are oriented 90 degrees from the other. It will be appreciated by those skilled in the art, that fluid outlets 38, 39 may be offset from each other at any other convenient angle. The fluid outlets 38, 39 are fluidly connected to a pump cavity 50.

Referring to FIGS. 2-5, an adjustable valve member 42 is radially located outside the impeller 16 and inside the pump cavity 50. The valve member 42 is arranged to adjustably direct the fluid through the respective fluid outlets 38, 39. The valve member 42 is comprised of an annular valve element 41 having a wall 45 with an exterior wall surface 49 and an interior wall surface 46 and a rectangular opening 44 extending through wall 45. In this example, wall 45 of the valve element 41 is spirally voluted from a generally thicker wall section at a first end 47 of opening 44 to a generally thinner wall section at a second end 48 of the opening 44. The impeller 16 is arranged to rotate inside the annular valve element 41 and the voluted interior wall surface 46. The pump housing 31 includes a stop member 52 extending into cavity 50. The valve element 41 further includes a stop surface 40 located at first end 47 of opening 44.

Figure 5:
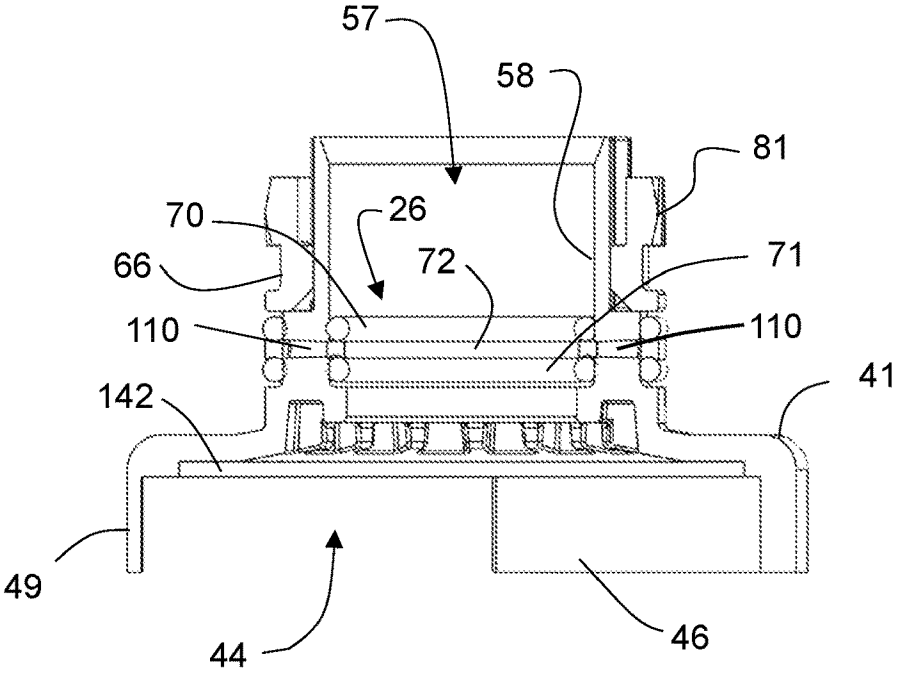
FIG. 5 illustrates a cross-sectional view through the valve member of the present disclosure.
Figure 4:
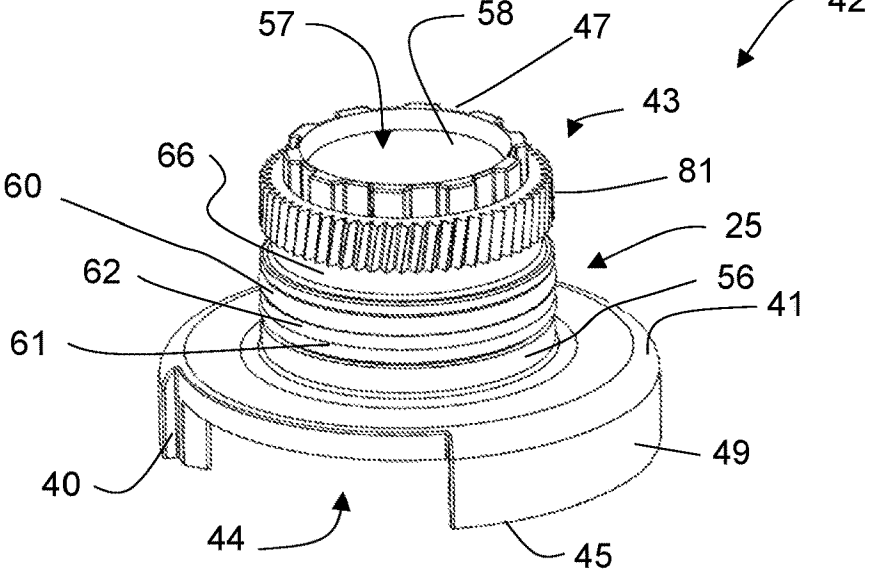
FIG. 4 illustrates a perspective view of the valve member of the present disclosure.

FIGS. 4 and 5 illustrate the example valve member 42 isolated from pump housing 31. The example valve member 42 of the present disclosure includes a cylindrical inlet member 47 located at upper section 43 of valve member 42. The upper section 43 of the valve member 42 further includes an annular outer surface 56 and an internal passage 57 enclosed by an annular interior surface 58. The outer surface 56 of upper section 43 includes an exterior fluid seal 25 of the sealing assembly. The exterior fluid seal comprising of a first elastomeric ring-shaped sealing member 60 and a second elastomeric ring-shaped sealing member 61 separated by a spacer ring 62. The exterior fluid seal 25 is located circumferentially about the perimeter of outer surface 56. The passage 57 further includes an interior fluid seal 26 of the sealing assembly consisting of a third elastomeric ring-shaped sealing member 70, and a second elastomeric ring-shaped sealing member 71 separated by a spacer ring 72, as is shown at FIG. 5. The interior fluid seal 26 is located parallel with and opposite from the exterior fluid seal 25. The exterior and interior fluid seals 25, 26 are used to provide a fluid tight seal between the valve member 42 and the pump housing 31.

Figure 6:
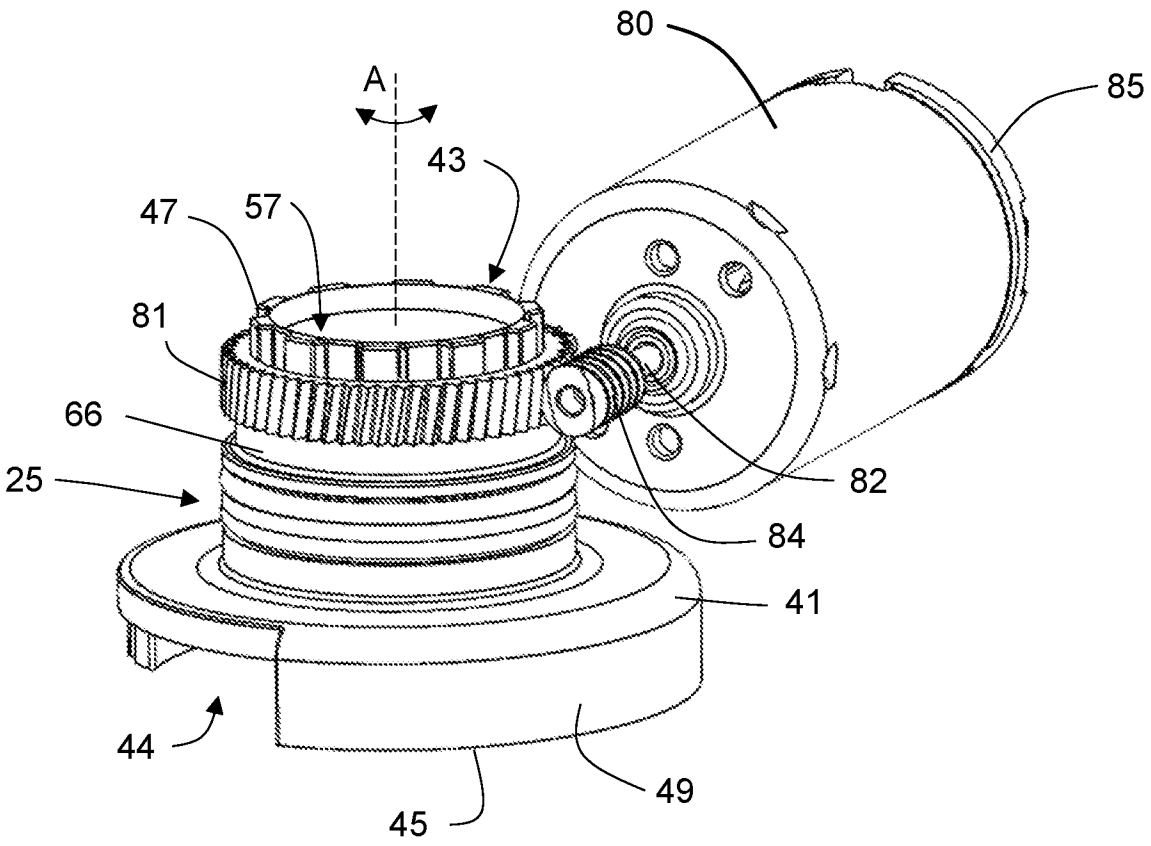
FIG. 6 illustrates a perspective view of the assembly of the valve member and actuator motor of the present disclosure.

With renewed reference to FIGS. 4 and 5, the upper section 43 of the valve member 42 further includes an actuation ring 66 having a spline tooth gear band 81 attached about the periphery of the outer surface 56. As is shown in FIG. 6 the teeth of the gear band 81 are arranged to be mechanically connected to a worm gear member 84 attached to a shaft 82 of an actuator motor 80. The valve member 42 is rotatable about a central axis A to adjust the fluid flow from the pump cavity 50 to fluid outlets 38, 39 which will be explained in more detail below. In this regard, the valve member 42 may be considered to be a rotary valve.

With reference to FIGS. 1 and 6, the actuator motor 80 of the present disclosure is arranged to be housed within an actuator motor housing 5 of the pump section 4. The actuator motor housing 5 is integrally formed with the pump housing 31, such as by injection molding. The actuator motor 80 includes a motor shaft 82 attached to the worm gear member 84 that engages the gear band 81 of the actuation ring 66. Rotation of the gear band 81 by worm gear 84 causes rotation of the valve member 42 about central axis A.

The actuator motor 80 is electrically connected to a remotely located controller through an electrical circuit section 85 on a rear face of the actuator motor 80 using an electrical connector (not shown). The controller selectively signals the actuator motor 80 to rotate worm gear 84 and thereby to cause rotation of valve member 42. As shown in FIG. 2, the actuator motor 80 is secured to actuator motor housing 5 using fasteners 86 that engage threaded holes 87 located on a front face of actuator motor 80 and a rear cover plate 88 is installed over electrical section 85. In operation, rotation of the valve member 42 selectively positions opening 44 to divert fluid flow from the pump cavity 50 to the first or the second fluid outlets 38, 39 or to both fluid outlets 38, 39 at the same time and thereby controlling the discharge of fluid from the pump section 4.

Figure 9:
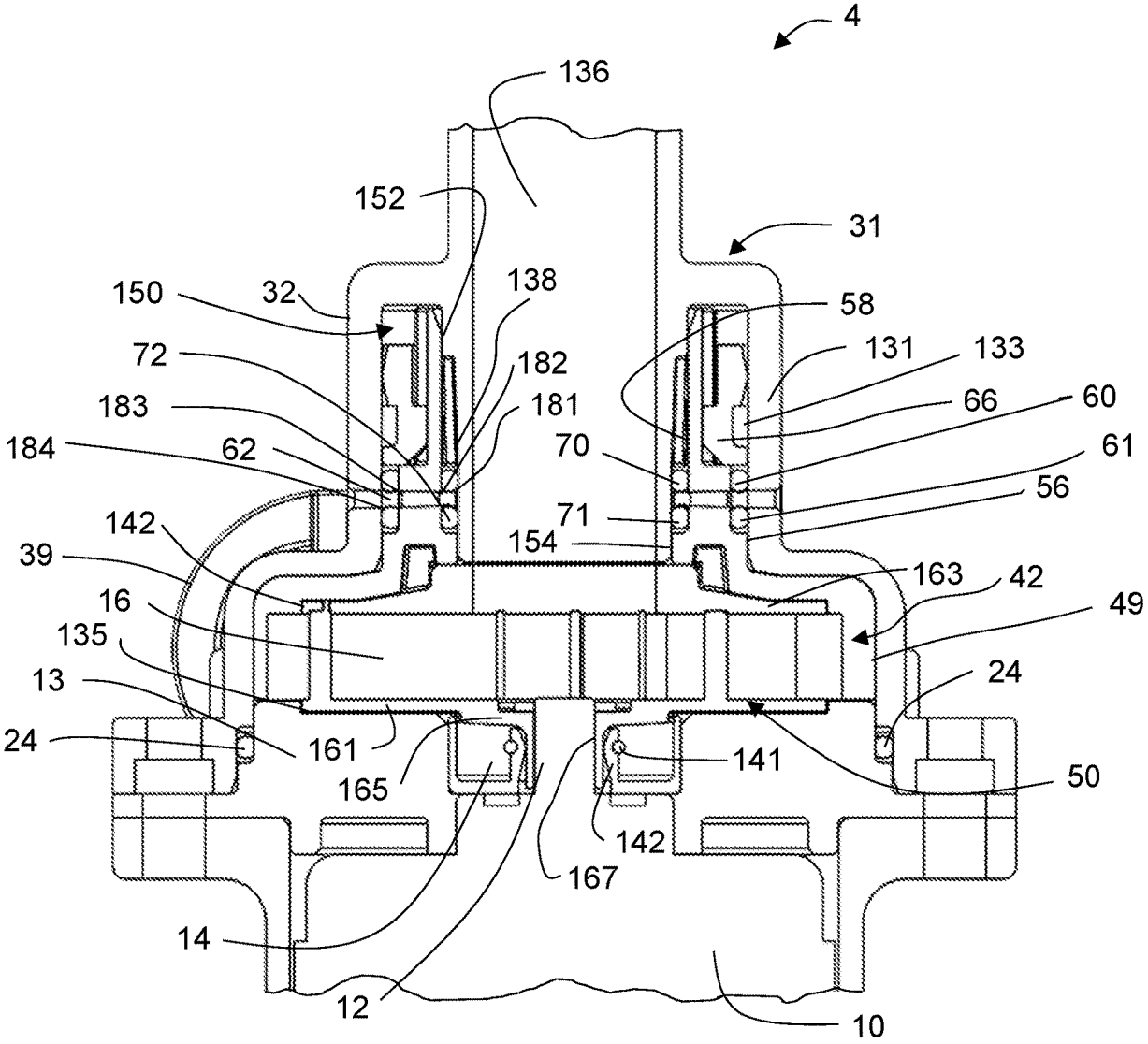
FIG. 9 illustrates a cross-sectional view through a portion of the assembled pump assembly of the present disclosure.

As can be best seen in FIG. 9, the pump housing 31 includes a cylindrical mounting cavity 150 extending internally in pump housing 31 defined by a wall 131. The mounting cavity 150 accepting therein the upper section 43 of valve member 42. The mounting cavity 150 includes an upper annular bearing surface 152 and a lower annular bearing surface 154. An upper portion of the valve member 42 interior surface 58 traversing against the upper bearing surface 152 and a lower portion of the valve member 42 interior surface 58 traversing against the lower bearing surface 154. The upper section 43 of the valve member 42 is arranged to be assembled within the mounting cavity 150 formed in the interior of pump housing 31. The internal passage 57 receives a tubular portion 136 of fluid inlet 36 that directs fluid at low pressure to the impeller 16. The first and second sealing members 60, 61 seal against a first interior surface 133 of mounting cavity 150. The third and fourth sealing members 70, 71 seal against a second interior surface 138 of the mounting cavity 150. Sealing members 60, 61 and 70, 71 are comprised of, for example, of O-rings fabricated from an elastomeric material such as Ethylene Propylene Diene Monomers (EPDM) rubber or the like. The spacer 62 of the exterior fluid seal 25 and the spacer 72 of the interior fluid seal 72 may also be comprised of EPDM rubber as well as a rigid thermoplastic. The spacer functions to retain the sealing members of the exterior and interior fluid seals 25, 26 in proper spaced relationship to the other.

Due to the rotation of the valve member 42 within the pump housing 31 the exterior and interior sealing assemblies mounted to valve member 42 are prone over time to wear and therefore to develop fluid leaks between the valve member 42 and pump housing 31. As was explained earlier, there is an advantage in providing a channel for leakage of fluid to the exterior of a pump due to a degradation or failure of the seal system. By controlling and directing leakage flow, leakage can be channeled away from the electrical pump motor 10 and/or the electrical valve actuator 80 and their electrical connections that can be damaged from fluid leakage. Since the actuator motor 80 is housed within a motor housing 5 and the motor housing 5 is molded as an integrated part of the pump housing 31, any fluid leaks from failing first and second sealing elements of the exterior 25 and or interior 26 fluid seals could travel to the actuator motor 80 and electrical circuit section 85 causing a potential failure of the actuator motor 80.

Figure 7:
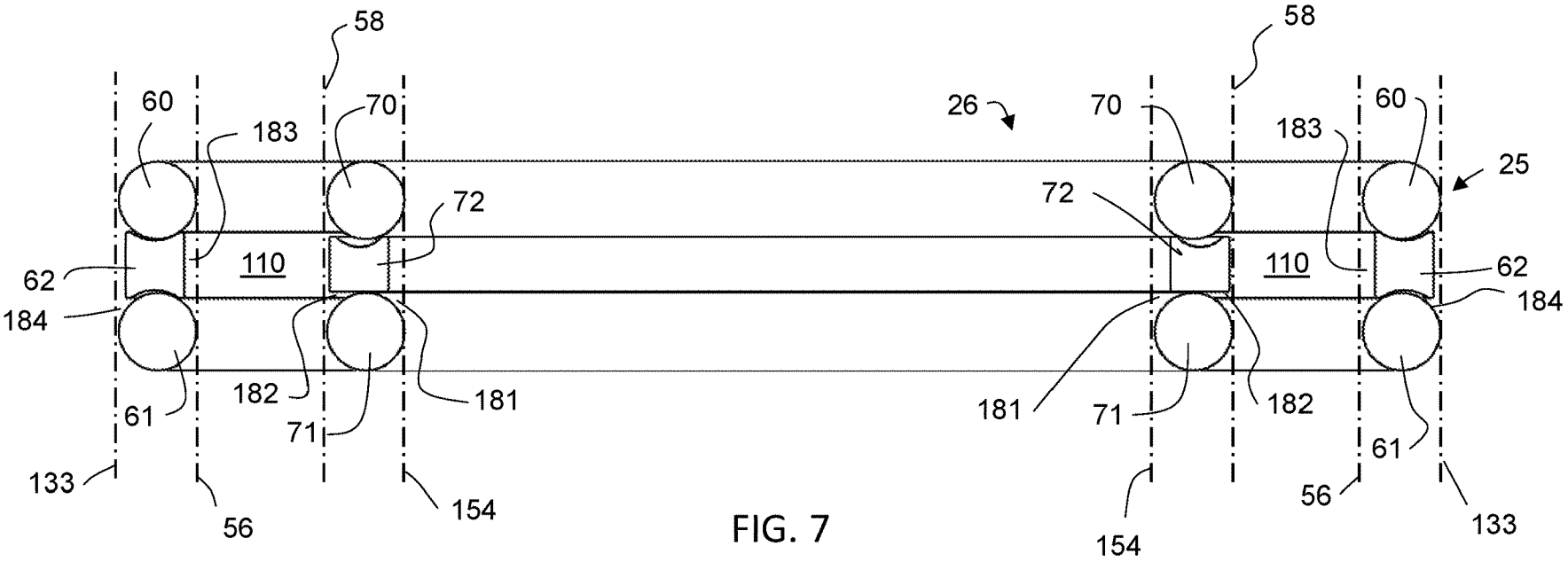
FIG. 7 illustrates a cross-sectional view of an example seal assembly of the present disclosure.

FIG. 7 illustrates the leak path through the interior fluid seal 26 and the exterior fluid seal 25 of the present disclosure. The exterior fluid seal 25 is comprised of the first and second sealing members 60, 61 respectively and a spacer 62 located between the sealing members 60, 61. The sealing members 60, 61 seal against outer surface 56 of valve member 42 and the interior surface 133 of mounting cavity 150. Outer surface 56 and interior surface 133 are illustrated in broken line in order to show the leak path more clearly.

The interior fluid seal 26 is aligned with outer fluid seal 25 and is comprised of the second and third sealing members 70, 71 respectively and spacer 72 located between the sealing members 70, 71. The sealing members 70, 71 seal against interior surface 58 of valve member 42 and lower bearing surface 154 of mounting cavity 150. As explained above, interior surface 58 and lower bearing surface 154 are illustrated in broken line in order to show the leak path more clearly. The valve member 42 also includes a pair of cylindrical valve passages 110 that extend through the valve member 42 upper section 43 between interior surface 58 and the outer surface 56. Each valve passage 110 is located between spacers 62 and 72 and located across from the other on opposite sides of the valve member 42. It will be understood by those skilled in the art that the valve member 42 may include a single valve passage 110 extending through the valve member 42 upper section 43 between interior surface 58 and the outer surface 56. Additionally, the valve member 42 may include a plurality, for example, three or more valve passages 110 extending through the valve member 42 upper section 43 between interior surface 58 and the outer surface 56. A pair of valve passages 110 have been used in this disclosure for ease of understanding the inventive concept of the disclosure.

The leak path is comprised of an inner leak path comprising a first cavity 181 located between lower bearing surface 154 of cavity 150 and the outer diameter of seal members 70, 71 and a second cavity 182 located between the outside diameter of seal members 70, 71, spacer 72 and the interior surface 58 of valve member 42. Fluid leakage from the interior fluid seal 26 will travel along the inner leak path and drain into one of the pair of valve passages 110.

An outer leak path comprises a third cavity 183 located between outer surface 56 of valve member 42 and the outer diameter of sealing members 60, 61 and spacer 62. A fourth cavity 184 is located between the outside diameter of sealing members 60, 61 of the exterior fluid seal 25 and interior surface 133 of mounting cavity 150. Fluid leaking between seal members 60, 61 and outer surface 56 of valve member 42 as well as any fluid contained in valve passage 110 is drained through the outer leak path to housing passages 100 to be expelled to exterior surface 32 of the pump housing 31 as is shown in FIG. 9.

Figure 8:
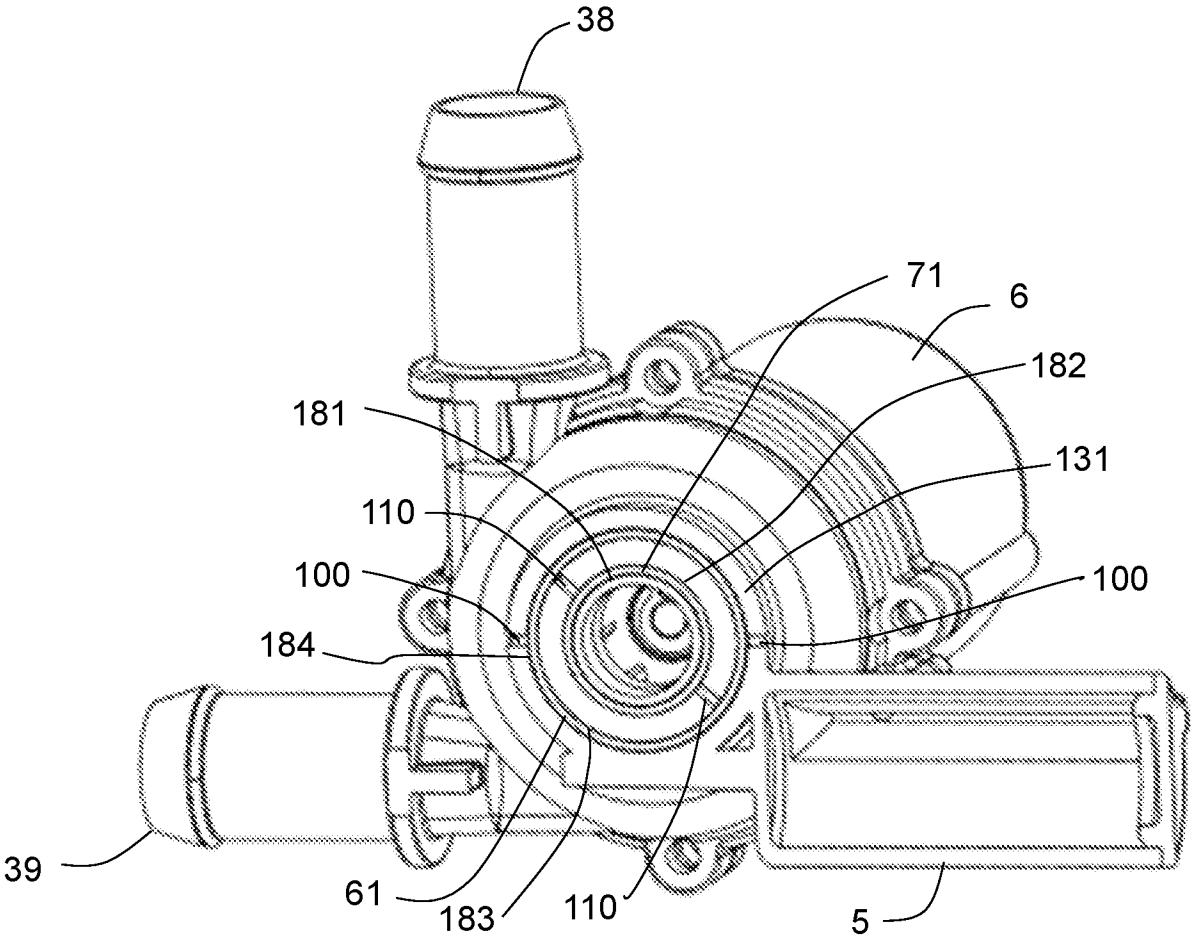
FIG. 8 illustrates a cross-sectional perspective view of a portion of the pump assembly, showing the leak path passages of the present disclosure.

As illustrated in FIG. 8, the inner leak path first and second cavities 181, 182, and the outer leak path third and fourth cavities 183, 184 as well as housing passages 100 remain stationary within the pump housing 31. As the valve member 42 rotates to position the opening 44 with fluid outlets 38, 39, each valve passage 110 of the pair of valve passages collects leaking fluid from the inner leak path first and second cavities 181, 182. Fluid collected by valve passages 110 is subsequently migrated to the outer leak path third and fourth cavities 183, 184 to be drained from one or both of the housing passages 100 to the exterior surface 32 of the pump housing 31.

Any one of the first through the fourth cavities 181-184 can contain the initial source of fluidic leakage. Fluid leakage is allowed to migrate from the source cavity to any one of the pair of housing passages 100 by travelling from respective cavity to cavity. For example, leakage from any one of the inner leak path first and second cavities 181, 182 would be drained into one of the pair of valve passages 110 to be migrated from the valve passages 110 to the outer leak path. The third cavity 183 would allow migration of a fluidic leak to a housing passage 100 though the fourth cavity 184.

Leakage from any one of the outer leak path cavities 183, 184 would migrate and be drained from one or more of housing passages 100. It should be noted that FIG. 7 shows an alignment of the inner leak path first and second cavities 181, 182, valve passage 110 and outer leak path third and fourth cavities 183, 184. This illustration is made only for convenience to explain the leak paths of the disclosure. Actual alignment is unlikely to occur. Additionally, the alignment between the inner leak path first and second cavities 181, 182, valve passage 110, and the outer leak path of third and fourth cavities 183, 184 and housing passage 100 shown in FIG. 9 would unlikely also not occur. However, the seal assembly and leak path described above does not require a linear alignment to provide the advantages taught and described by the disclosure.

With renewed reference to FIG. 9 a cross-sectional view through the assembled pump housing 31 is shown. This view illustrates the valve member 42 mounted within the pump housing cavity 50. The impeller 16 is shown located within the valve member 42 resting above mounting plate 13. An annular skirt 165 having a centrally located cylindrical cavity 167 extends from the impeller 16 into the seal seat 19. The cavity 167 axially aligning with the mounting plate 13 opening 11. The internal diameter of the cavity 167 being slightly smaller than the exterior diameter of the motor shaft 12. Motor shaft 12 of pump motor 10 extends through opening 11 and is press-fit into cavity 167 attaching the impeller 16 to motor shaft 12. A steel spring 141 biases the annular elastomeric walls 142 against the skirt 165 that surround the motor shaft 12 making a fluid tight seal between walls 142 and the skirt 165 and preventing a potential infiltration of fluid from the pump cavity 50 from reaching the pump motor 10.

Mounting plate 13 further includes a shoulder 135 defined on an interior surface of wall 21 located circumferentially about mounting plate 13. A second shoulder 142 is molded circumferentially in the interior surface of the valve element 41. Shoulder 135 arranged to receive therein the first vane plate 161 and shoulder 142 arranged to receive therein the second vane plate 163 of impeller 16. The shoulders 135, 142 providing a bearing surface that stabilizes the rotation of the impeller 16.

Figure 10B:
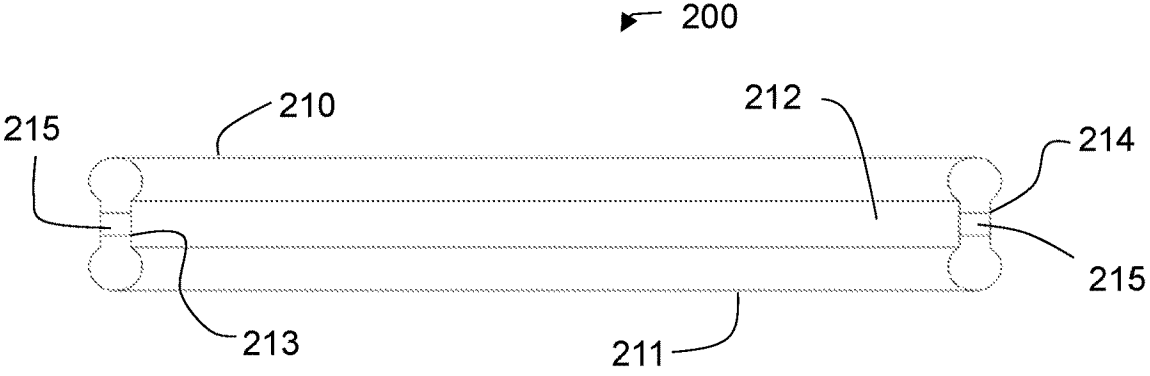
FIG. 10B illustrates a cross-sectional view of FIG. 10A of the present disclosure.
Figure 10A:
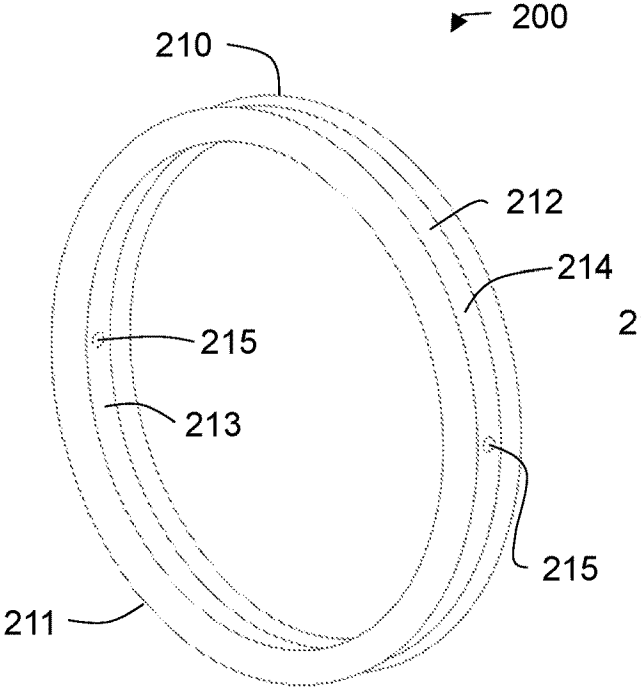
FIG. 10A illustrates a perspective view of a first embodiment of an integrated seal gasket of the present disclosure.

Turning now to FIG. 10A a perspective view of a first embodiment of an integrated seal gasket 200 with a leak path is illustrated. The integrated seal gasket 200 is comprised of a first lobed sealing member 210 and a second lobed sealing member 211 positioned between a rectangular spacer portion 212. The lobed sealing members 210, 211 extend from opposite ends of the spacer portion 212. As can be best seen in the sectional view of FIG. 10B, the first and second sealing members 210, 211 and spacer portion 212 are formed as an integral unit. A pair of cylindrical seal passages 215 located opposite from the other, extend through the spacer portion 212 from an inner surface 213 to an outer surface 214 of the spacer portion 212. It will be understood by those skilled in the art that only a single seal passage 215 can be located through the spacer portion 212 from an inner surface 213 to an outer surface 214 of the spacer portion 212. A pair of seal passages 215 have been used in this disclosure for ease of understanding the inventive concept of the disclosure. The sealing members 210, 211 and integrated spacer portion 212 are comprised of, for example, an elastomeric material such as Ethylene Propylene Diene Monomers (EPDM) rubber or the like. The integrated seal gasket 200 can be used to form the exterior fluid seal 25 and the interior fluid seal 26 used with valve member 42.

Figure 11:
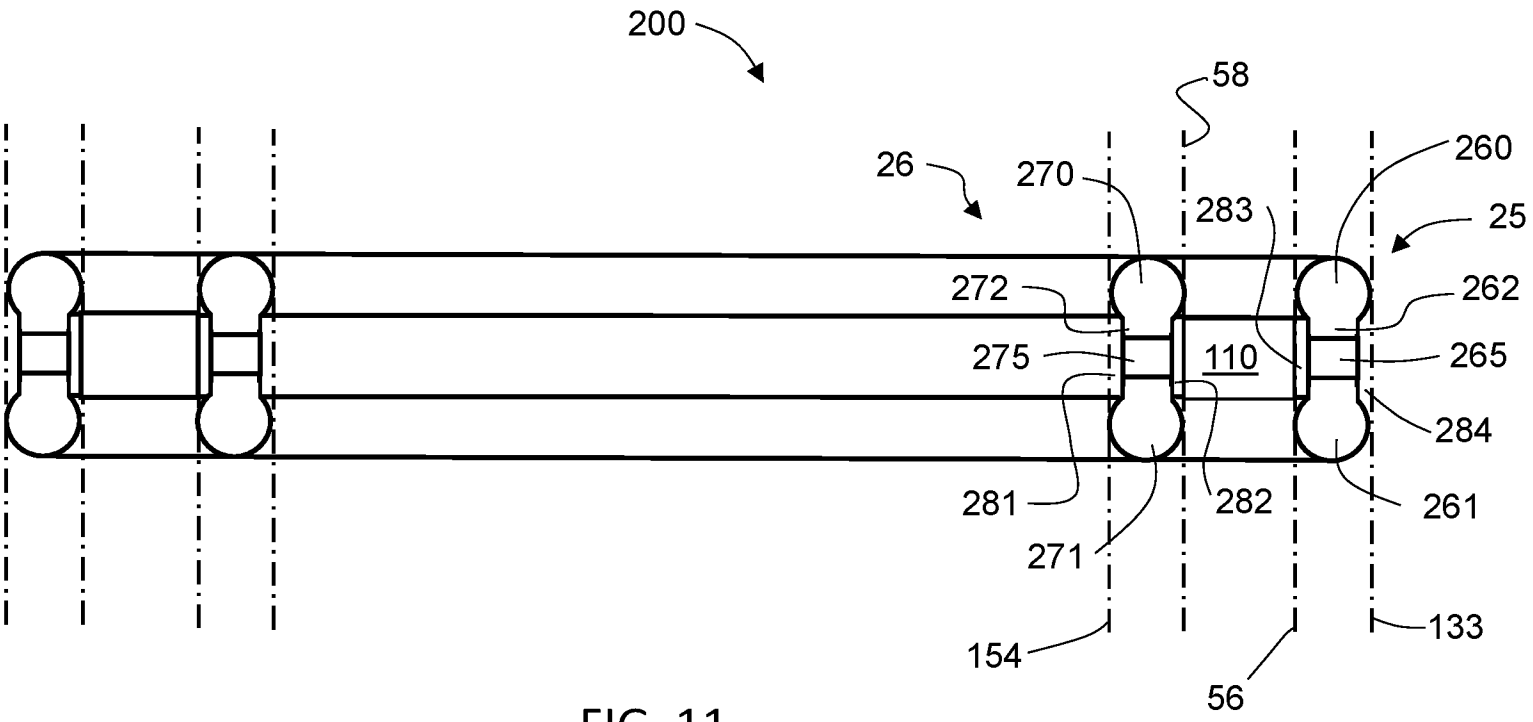
FIG. 11 illustrates a cross sectional view of the integrated seal gasket illustrated in FIG. 10B of the present disclosure.

FIG. 11 illustrates the leak path through the interior fluid seal 26 and the exterior fluid seal 25 of the integrated seal gasket 200. The leak path explanation will be made using only one side of the fluid seal. The leak path through the opposite side functions as the side that will be explained. The exterior fluid seal 25 is comprised of first and second ring-shaped sealing members 260, 261 respectively and their integrated spacer 262. A cylindrical outer seal passage 265 extends through the spacer 262. The sealing members 260, 261 seal against outer surface 56 of valve member 42 and the interior surface 133 of mounting cavity 150. Outer surface 56 and interior surface 133 are illustrated in broken line in order to show the leak path more clearly.

The interior fluid seal 26 is aligned with outer fluid seal 25 and is comprised of the second and third ring-shaped sealing members 270, 271 respectively and an integrated spacer 272. A cylindrical inner seal passage 275 extends through the spacer 272. The sealing members 270, 271 seal against interior surface 58 of valve member 42 and lower bearing surface 154 of mounting cavity 150. As explained above, interior surface 58 and lower bearing surface 154 are illustrated in broken line in order to show the leak path more clearly. The valve member 42 also includes a pair of cylindrical valve passages 110 that extend through the valve member 42 upper section 43 between interior surface 58 and the outer surface 56. Each valve passage 110 of the pair of valve passages is located between the spacers 262 and 272 and located across from the other on opposite sides of the valve member 42.

An inner leak path comprises a first cavity 281 circumferentially located between lower bearing surface 154 of cavity 150 and the outer diameters of seal members 270, 271 and outer surface of spacer 275. A second cavity 282 is circumferentially formed between the outside diameters of seal members 270, 271 and the inner surface of spacer 272 and the interior surface 58 of valve member 42. The inner leak path migrates fluid leaks from first cavity 281 through the inner seal passage 275 to the second cavity 282, to be collected by valve passage 110.

An outer leak path comprises a third cavity 283 circumferentially located between outer surface 56 of valve member 42 and the outer diameter of sealing members 260, 261 and the inner surface of spacer 262. A fourth cavity 284 is located between the outside diameter of sealing members 260, 261 and the outer surface of spacer 262 and interior surface 133 of mounting cavity 150. Fluid in the third cavity 183 migrates to the fourth cavity 284 through outer seal passage 265. Fluid leaking between seal members 260, 261 and the outer surface 56 of valve member 42 is contained in cavity 283. Additionally, fluid contained in valve passage 110 is drained into third cavity 283. Fluid in third cavity 283 migrates through outer seal passage 265 to the fourth cavity 284 to be expelled through one or more of the pair of housing passages 100 to the exterior surface 32 of the pump housing 31 as is shown in FIG. 12.

Figure 12:
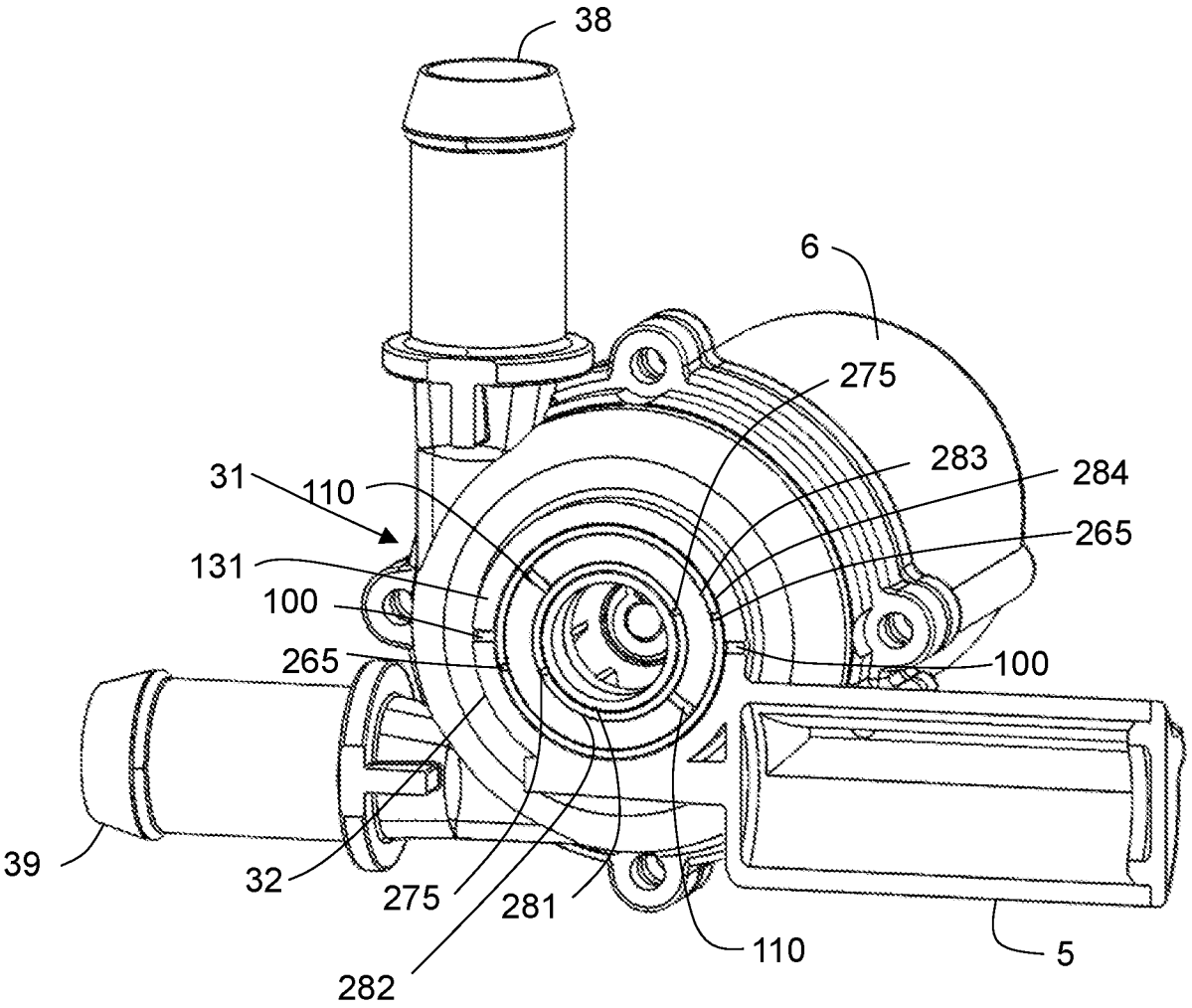
FIG. 12 illustrates a cross-sectional perspective view of a portion of the pump assembly, showing the leak path passages of the integrated seal gasket of the present disclosure.

As illustrated in FIG. 12, the inner leak path consisting of first and second cavities 281, 282, and their associated inner seal passages 275 and the outer leak path third and fourth cavities 283, 284 and their associated outer seal passage 265 remain stationary within the pump housing 31. As the valve member 42 rotates to position the opening 44 with fluid outlets 38, 39, each valve passage 110 of the pair of valve passages collects any fluid contained in the inner leak path second cavity 282. Valve passages 110 collect fluid in the second cavity 282 that has either originated from a leaking seal member 270, 271 and that has pooled in cavity 282, or migrated from cavity 281 through inner seal passage 275. Fluid in the valve passage 110 is drained into the third cavity 283, and the outer seal passage 265 to fourth cavity 284. Fluid that reaches the fourth cavity 284 can subsequently be drained from one or both of the housing passages 100 to the exterior surface 32 of the pump housing 31.

Any one of the first through the fourth cavities 281-284 can contain the initial source of fluidic leakage. Fluid leakage is allowed to migrate from the source cavity to any one of the pair of housing passages 100 by travelling from respective cavity to cavity. For example, fluid leakage from the first cavity 281, would drain to the second cavity 282 via the inner seal passage 275. Fluid in the second cavity 282 is drained into and collected by one of the pair of valve passages 110. The valve passages 110 providing a drain path to the third cavity 283. Fluid drained into the third cavity 283 would migrate across to fourth cavity 284 via outer seal passage 265 to be expelled from the pump housing through one or both of the housing passages 100.

Other forms and types of seal gaskets can be used to provide the leak path of the present disclosure. FIG. 13A illustrates a second embodiment of an integrated seal gasket 30). The integrated seal gasket 300 is comprised of a first quad ring sealing member 310 and a second quad ring sealing member 311 positioned between a rectangular spacer portion 312. Quad ring seals provide four direct points of support that produces twice the sealing surface of a lobed or O-ring seal and therefore a more secure seal. Additionally, quad ring seals exhibits lower friction against a sealing surface and due to its relatively square cross-section, it resists spiral twisting in applications requiring sealing of rotating or oscillating components. The quad ring sealing members 310, 311 extend from opposite ends of the spacer portion 312.

Figure 13B:
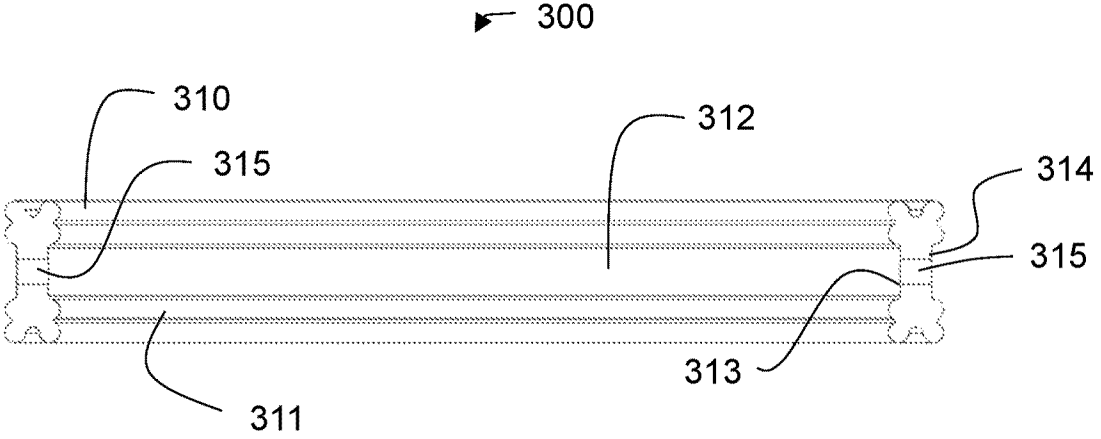
FIG. 13B illustrates a cross-sectional view of FIG. 13A of the present disclosure.
Figure 13A:
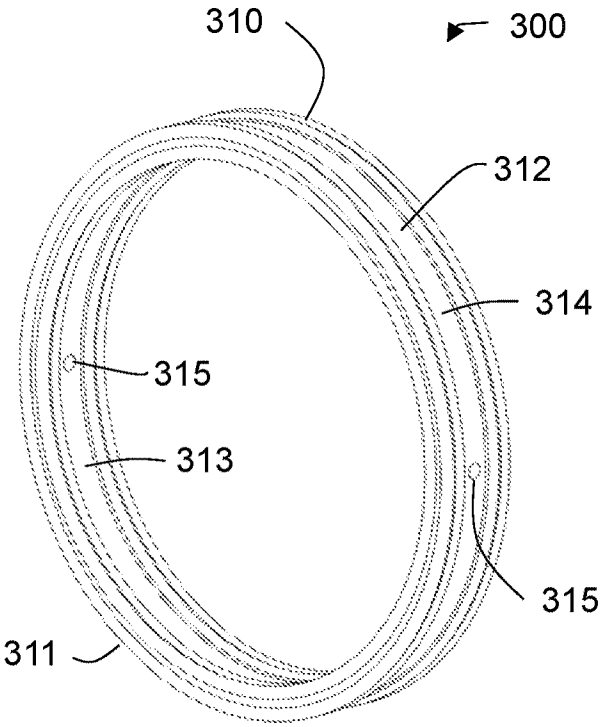
FIG. 13A illustrates a perspective view of a second embodiment of the integrated seal gasket of the present disclosure

As can be best seen in the sectional view of FIG. 13B, the first and second quad rings 310, 311 and spacer portion 312 are formed as an integral unit. One or more seal passages 315, extend through the spacer portion 312 from an inner surface 313 to an outer surface 314 of the spacer. The sealing members 310, 311 and spacer portion 312 are comprised of, for example, an elastomeric material such as Ethylene Propylene Diene Monomers (EPDM) rubber or the like. The integrated seal gasket 300 can be used to form the exterior fluid seal 25 and the interior fluid seal 26 used with valve member 42. In this second embodiment a leak path through the interior fluid seal 26 and the exterior fluid seal 25 of the integrated seal gasket 300 is formed in the same manner as explained above for seal gasket 200, shown in FIG. 11.

Figure 14B:
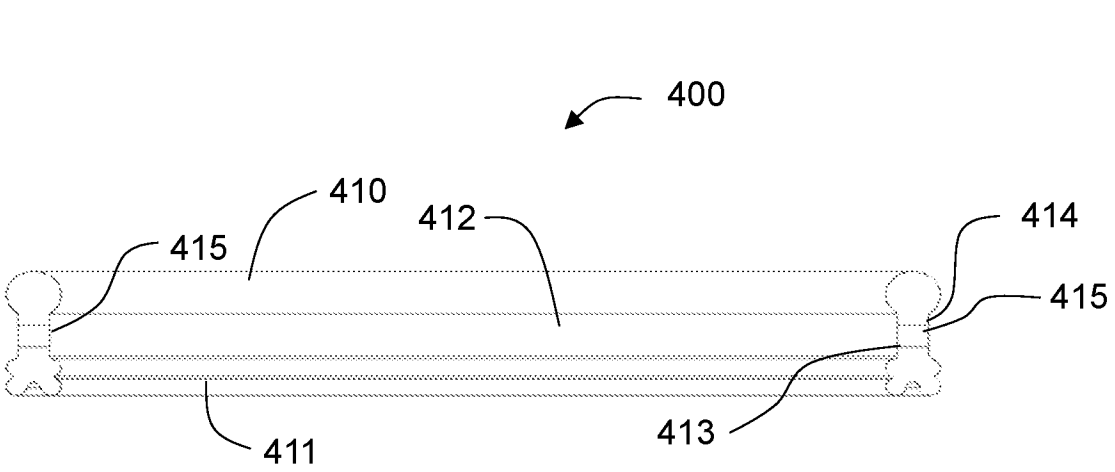
FIG. 14B illustrates a cross-sectional view of FIG. 14A of the present disclosure.
Figure 14A:
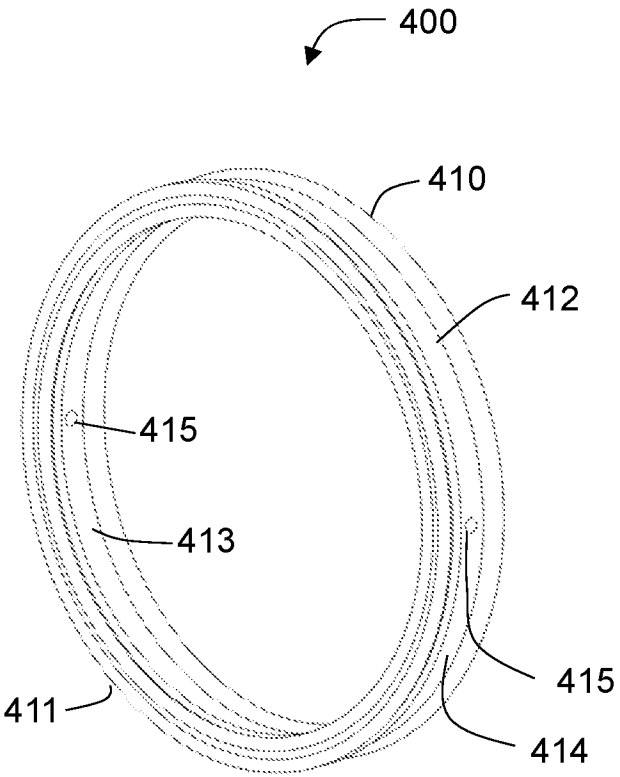
FIG. 14A illustrates a perspective view of a third embodiment of the integrated seal gasket of the present disclosure.

FIG. 14A illustrates a third embodiment of an integrated seal gasket 400. The integrated seal gasket 400 is comprised of a first lobed sealing member 410 and a second quad ring sealing member 411 positioned between a rectangular spacer portion 412. In this third embodiment, the advantages of the quad ring seal is coupled with the cost efficiency, provided by the traditional lobed sealing member. The first lobed sealing member 410 and the quad ring sealing member 411 each extend from opposite end of the spacer portion 412.

As can be best seen in the sectional view of FIG. 14B the first lobed and second quad ring sealing members 410, 411 and spacer portion 412 are formed as an integral unit. One or more seal passages 415 extend through the spacer portion 412 from an inner surface 413 to an outer surface 414 of the spacer portion 412. The lobed sealing member 410, and the quad lobed sealing member 411 as well as spacer portion 412 are comprised of, for example, an elastomeric material such as Ethylene Propylene Diene Monomers (EPDM) rubber or the like. The integrated seal gasket 400 can be used to form the exterior fluid seal 25 and the interior fluid seal 26 used with valve member 42. In this second embodiment a leak path through the interior fluid seal 26 and the exterior fluid seal 25 of the integrated seal gasket 400 is formed in the same manner as explained above for the integrated seal gasket 200 shown in FIG. 11.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," or "controller" within a claim is understood and intended to refer to structures known to those skilled in the relevant art, as further modified or enhanced by the features of the claims themselves and is not intended to invoke 35 U.S.C. § 112(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A sealing assembly for a pump with a leak path comprising:

a pump housing having a cylindrical mounting cavity, a fluid inlet, at least one fluid outlet, and at least one housing passage extending to an exterior surface of the pump housing;

an impeller driven by a motor for moving a fluid from the fluid inlet to the fluid outlet;

a valve for controlling a flow of fluid through the at least one fluid outlet, the valve including an annular interior surface, the annular interior surface bearing against a first surface of the mounting cavity, and an annular exterior surface bearing against a second surface of the mounting cavity and at least one valve passage extending through the valve;

an interior fluid seal located about a perimeter of the valve annular interior surface forming a fluidic seal between the valve annular interior surface and the mounting cavity first surface, the interior fluid seal including an inner leak path in fluid communication with the at least one valve passage, the at least one valve passage collecting fluid leaking in the interior fluid seal from the inner leak path; and an exterior fluid seal located about a perimeter of the valve annular exterior surface forming a fluidic seal between the valve annular exterior surface and the mounting cavity second surface, the exterior fluid seal including an outer leak path through the exterior fluid seal, the outer leak path in fluid communication with the at least one valve passage and with the at least one housing passage, the outer leak path collecting fluid leaking in the exterior fluid seal and fluid contained in the at least one valve passage and draining the fluid leaking in the exterior fluid seal to the at least one housing passage and to an exterior of the pump housing.

2. The assembly as claimed in claim 1, wherein the interior fluid seal comprises a first ring-shaped sealing member and a second ring-shaped sealing member separated by a first spacer ring.

3. The assembly as claimed in claim 2, wherein the exterior fluid seal comprises a first ring-shaped sealing member and a second ring-shaped sealing member separated by a second spacer ring.

4. The assembly as claimed in claim 3, wherein the at least one valve passage extends through the valve between the first spacer ring and the second spacer ring.

5. The assembly as claimed in claim 4, wherein the inner leak path comprises a first cavity and a second cavity in fluid communication with each other through the interior fluid seal, the second cavity in fluid communication with the at least one valve passage, wherein the fluid leaking in the interior fluid seal travels through the inner leak path to be collected by the at least one valve passage.

6. The assembly as claimed in claim 5, wherein the outer leak path includes a third and a fourth cavity in fluid communication with each other through the exterior fluid seal, the third cavity in fluid communication with the at least one valve passage, wherein the fluid leaking in the exterior fluid seal travels through the outer leak path, the third cavity further receiving fluid collected by the at least one valve passage from the second cavity.

7. The assembly as claimed in claim 6, wherein the at least one housing passage is in fluid communication with the fourth cavity, the fourth cavity receiving the leaking fluid from the third cavity draining the leaking fluid in the fourth cavity to the exterior of the pump housing.

8. The assembly as claimed in claim 2, wherein the interior fluid seal first and second sealing members are each composed of an elastomeric O-ring, the interior fluid seal first and second sealing members separated from each other by the first spacer ring.

9. The assembly as claimed in claim 3, wherein the exterior fluid seal first and second sealing members are each composed of an elastomeric O-ring, the exterior fluid seal first and second sealing members separated from the other by the second spacer ring.

10. A sealing assembly for a pump with a leak path comprising:

a pump housing having an annular mounting cavity, a fluid inlet, at least one fluid outlet, and at least one housing passage extending to an exterior of the pump housing; an impeller driven by a motor for moving a fluid from the fluid inlet to the at least one fluid outlet;

a valve for controlling a flow of fluid through the at least one fluid outlet, the valve further including an annular internal cavity defined by an interior surface, the interior surface bearing on a first surface of the mounting cavity and an annular exterior surface bearing against a second surface of the mounting cavity and at least one valve passage extending through the valve;

an interior seal gasket located about a perimeter of the valve interior surface forming a fluidic seal between the valve interior surface and the mounting cavity first surface, the interior seal gasket having at least one seal passage extending through the interior seal gasket that forms a portion of an inner leak path through the interior seal gasket, the inner leak path in fluid communication with the at least one valve passage, the at least one valve passage collecting fluid leaking in the interior seal gasket; and an exterior seal gasket located about a perimeter of the valve exterior surface forming a fluidic seal between the valve exterior surface and the mounting cavity second surface, the exterior seal gasket having at least one seal passage extending through the exterior seal gasket that forms a portion of an outer leak path through the exterior seal gasket, the outer leak path in fluid communication with the at least one valve passage and with the at least one housing passage, the outer leak path collecting fluid leaking in the exterior seal gasket and fluid contained in the at least one valve passage draining the fluid leaking in the exterior seal gasket through the outer leak path to the at least one housing passage and to the exterior of the pump housing.

11. The assembly as claimed in claim 10, wherein the interior seal gasket comprises a first ring-shaped sealing member, a second ring-shaped sealing member and a first rectangular spacer portion composed as an integral unit with the first and the second sealing members extending from opposite ends of the first spacer portion, the at least one seal passage extending through the first spacer portion.

12. The assembly as claimed in claim 11, wherein the exterior seal gasket comprises a first ring-shaped sealing member, a second ring-shaped sealing member and a second rectangular spacer portion composed as an integral unit with the first and the second sealing members extending from opposite ends of the second spacer portion, the at least one seal passage extending through the second spacer portion.

13. The assembly as claimed in claim 12, wherein the at least one valve passage comprises a plurality of valve passages extending through the valve between the first and second spacer portions, each of the interior seal gasket at least one seal passage and the exterior seal gasket at least one seal passage comprised of a pair of seal passages in periodic alignment with a respective one or more of the plurality of valve passages.

14. The assembly as claimed in claim 13, wherein the inner leak path comprises a first cavity and a second cavity in fluid communication with a respective seal passage of the interior seal gasket pair of seal passages, each seal passage of the interior seal gasket pair of seal passages located between the first and second cavities, wherein the fluid leaking in the interior seal gasket travels through the inner leak path to be collected by one or both of the interior seal gasket pair of valve passages from the second cavity.

15. The assembly as claimed in claim 14, wherein the outer leak path comprises a third cavity and a fourth cavity in fluid communication with a respective seal passage of the exterior seal gasket pair of seal passages, each seal passage of the exterior seal gasket pair of seal passages located between the third and fourth cavities, where in the fluid leaking in the exterior seal gasket and fluid collected by one or both of the exterior seal gasket pair of valve passages migrates through the outer leak path to the fourth cavity.

16. The assembly as claimed in claim 15, wherein the at least one housing passage is in fluid communication with the fourth cavity, the fourth cavity receiving the leaking fluid from the third cavity draining the leaking fluid in the fourth cavity to the exterior of the pump housing.

17. The assembly as claimed in claim 10, wherein each of the interior and the exterior seal gaskets comprise a first lobed ring-shaped sealing member, a second lobed ring-shaped sealing member, and a rectangular spacer portion composed as an integral unit with the first lobed sealing member and the second lobed sealing member extending from opposite ends of the spacer portion.

18. The assembly as claimed in claim 10, wherein the interior and exterior seal gaskets comprise a first quad-ring sealing member, a second quad-ring sealing member, and a rectangular spacer portion composed as an integral unit with the first quad-ring sealing member and the second quad-ring sealing member extending from opposite ends of the spacer portion.

19. The assembly as claimed in claim 10, wherein the interior and exterior seal gaskets comprise of a first lobed ring-shaped sealing member, a second quad-ring sealing member, and a rectangular spacer portion composed as an integral unit with the first lobed sealing member and the second quad-ring sealing member extending from opposite ends of the spacer portion.

* * * * *